US008104647B2

(12) United States Patent
Bober et al.

(10) Patent No.: US 8,104,647 B2
(45) Date of Patent: Jan. 31, 2012

(54) CLOSURE FOR A PRESSURIZABLE CONTAINER

(75) Inventors: Andrew M. Bober, Racine, WI (US); Kirk Reimann, Franksville, WI (US); Haim Bar-Noy, Londonderry, NH (US); Kevin J. Markey, Brookfield, WI (US); Jonathan L. Ludtke, Burlington, WI (US); Mark T. Maclean-Blevins, Westminster, MD (US)

(73) Assignee: Diversey, Inc., Sturtevant, WI (US)

( * ) Notice: Subject to any disclaimer, the term of this patent is extended or adjusted under 35 U.S.C. 154(b) by 603 days.

(21) Appl. No.: 12/306,192

(22) PCT Filed: Jun. 29, 2007

(86) PCT No.: PCT/US2007/072491

§ 371 (c)(1),
(2), (4) Date: Dec. 22, 2008

(87) PCT Pub. No.: WO2008/005841

PCT Pub. Date: Jan. 10, 2008

(65) Prior Publication Data

US 2009/0194610 A1 Aug. 6, 2009

Related U.S. Application Data

(60) Provisional application No. 60/817,934, filed on Jun. 30, 2006.

(51) Int. Cl.
*B65D 83/00* (2006.01)

(52) U.S. Cl. ..... 222/401; 222/153.09; 222/386.5; 222/385; 222/389; 222/481.5; 239/337; 239/373

(58) Field of Classification Search ..... 222/401–402, 222/481.5, 387, 389, 386.5, 153.09, 153.11, 222/321.7, 385, 321.9, 340, 373, 258, 383.1, 222/182, 181.1, 181.2, 153.1; 239/333, 337, 239/360, 373

See application file for complete search history.

(56) References Cited

U.S. PATENT DOCUMENTS

| | | | |
|---|---|---|---|
| 2,053,282 | A | 9/1936 | Gewalt |
| D102,047 | S | 11/1936 | Farmer |
| 2,241,846 | A | 5/1941 | Cuthbert |
| 2,544,854 | A | 3/1951 | Oys et al. |
| 3,023,969 | A | 3/1962 | Hudson et al. |
| 3,207,387 | A | 9/1965 | Brickman |
| 3,457,016 | A | 7/1969 | Gotberg |
| 3,584,769 | A | 6/1971 | Pinke |

(Continued)

FOREIGN PATENT DOCUMENTS

| | | |
|---|---|---|
| DE | 20114897 | 1/2001 |

(Continued)

OTHER PUBLICATIONS

International Search Report from the European Patent Office, Feb. 12, 2008.

*Primary Examiner* — Frederick C. Nicolas
(74) *Attorney, Agent, or Firm* — Gregory S. Bollis

(57) ABSTRACT

An improved pressurizable container and closure. Some embodiments provide an improved sealing arrangement for a pressurized container and closure. Other embodiments provide an improved closure is easier to grasp and/or manipulate. Some embodiments are directed towards a venting assembly for a pressurizable container.

26 Claims, 4 Drawing Sheets

U.S. PATENT DOCUMENTS

| | | | | | |
|---|---|---|---|---|---|
| 4,930,664 | A | * | 6/1990 | Ellison | 222/1 |
| D365,987 | S | | 1/1996 | Willard | |
| D366,840 | S | | 2/1996 | Schagerstrom et al. | |
| D371,413 | S | | 7/1996 | Crausby et al. | |
| 5,650,113 | A | | 7/1997 | Gregory et al. | |
| D451,827 | S | | 12/2001 | Winters | |
| D457,697 | S | | 5/2002 | Savage | |
| 6,718,852 | B1 | | 4/2004 | Bickel et al. | |
| D497,698 | S | | 10/2004 | Vinci | |
| D508,202 | S | | 8/2005 | Dobson et al. | |
| 6,981,533 | B2 | | 1/2006 | Zorzo | |
| D514,760 | S | | 2/2006 | Schoolcraft et al. | |
| D520,873 | S | | 5/2006 | Lovell | |
| D529,380 | S | | 10/2006 | Yelland | |
| D530,611 | S | | 10/2006 | Nusbaum et al. | |
| D533,061 | S | | 12/2006 | Li | |
| D558,070 | S | * | 12/2007 | Bober et al. | D10/46.2 |
| D586,680 | S | * | 2/2009 | Bober et al. | D10/101 |
| 7,581,662 | B2 | * | 9/2009 | Powell | 222/401 |
| 2005/0274734 | A1 | | 12/2005 | Haimi | |
| 2006/0131331 | A1 | | 6/2006 | Powell | |
| 2010/0181345 | A1 | * | 7/2010 | Hilarides | 222/386.5 |

FOREIGN PATENT DOCUMENTS

| | | |
|---|---|---|
| DE | 202004019888 | 3/2005 |
| EP | 0537920 | 4/1993 |
| EP | 1180343 | 2/2002 |
| EP | 1582475 | 10/2005 |
| FR | 2871442 | 12/2005 |
| GB | 854951 | 11/1960 |
| GB | 2181419 | 4/1987 |
| JP | 08238446 | 9/1996 |
| JP | 09175556 | 7/1997 |
| JP | 2000117163 | 4/2000 |
| WO | 01/70586 | 9/2001 |
| WO | 2006/066634 | 6/2006 |

* cited by examiner

CLOSURE FOR A PRESSURIZABLE CONTAINER

CROSS-REFERENCE TO RELATED APPLICATIONS

This application claims the benefit of U.S. Provisional Patent Application No. 60/1817,934, filed on Jun. 30, 2006, which is hereby incorporated by reference.

BACKGROUND OF THE INVENTION

Some mops or similar floor treating implements have used a pressurized container for the delivery of a cleaning solution, floor coating, or other floor treatment for years. For example, U.S. Pat. Nos. 3,457,016 and 2,053,282, and European Patent No. 1,180,343 show such a device. Many modern pressure containers, such as the one illustrated in European Patent No 1,180,343, generally include a selectively removable closure to allow the container to be refilled. Since the container is pressured, an o-ring or similar sealing device must be used between the closure and the container to form a sealing engagement between the closure and the container. Without such a seal, the container would fail to maintain pressure.

Although modern pressurized containers incorporate a sealing member between the closure and the container, such scaling members wear over time and eventually fail due to the means of engagement between the closure and the container. Specifically, as shown in European Patent No. 1,180,343, the closure is threaded onto the container. As the seal (included in closure) engages the container, the seal is subjected to rotating frictional force along the top of the container as the closure is full threaded onto the container. This eventually causes enough wear on the seal to cause the seal to fail.

Accordingly, there is a need for an improved sealing arrangement between a closure and a container, wherein the container is pressurized.

SUMMARY OF THE INVENTION

The present invention relates to the field of pressurized containers for the delivery of a cleaning, coating, or other treating solution. More particularly, the invention has particular utility for use on mops utilizing a pressurized source of solution for mopping operations.

Some embodiments of the present invention provide an improved pressurizable container and closure.

Other embodiments are directed an improved closure.

Some embodiments are directed to a sealing arrangement for a pressurized container and closure.

Some embodiments are directed toward a container closure for a container; wherein the closure is easier to grasp and/or manipulate.

Some embodiments are directed towards a venting assembly for a pressurizable container.

Further aspects of the present invention together with the organization and operation thereof, will become apparent from the following detailed description of the invention when taken in conjunction with the accompanying drawings.

Figure 1:
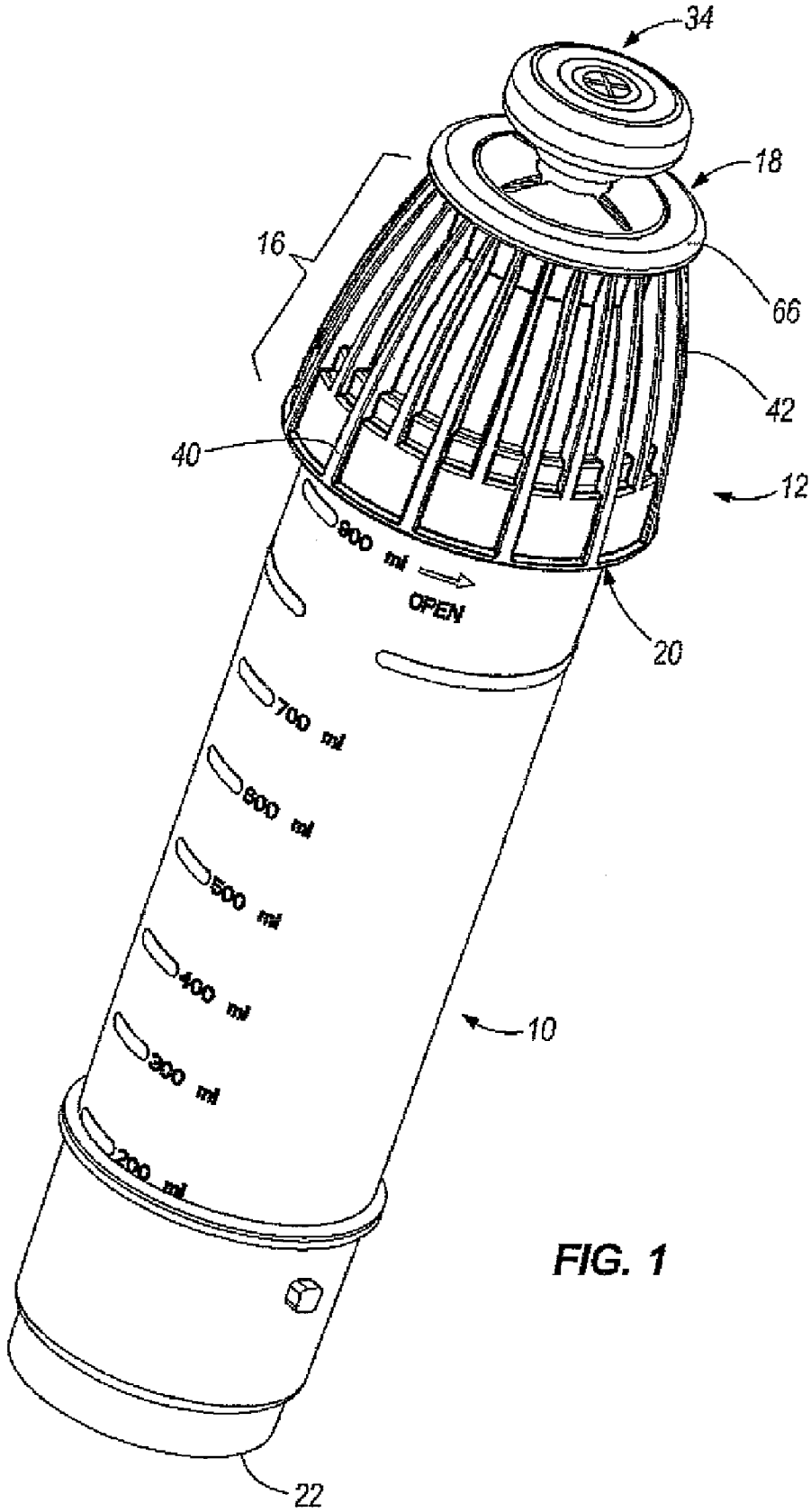
FIG. 1 is a top perspective view of a container coupled to a closure embodying aspects of the present invention.

FIG . 3 is a side view of the container and closure shown in FIG. 1.

Figure 4:
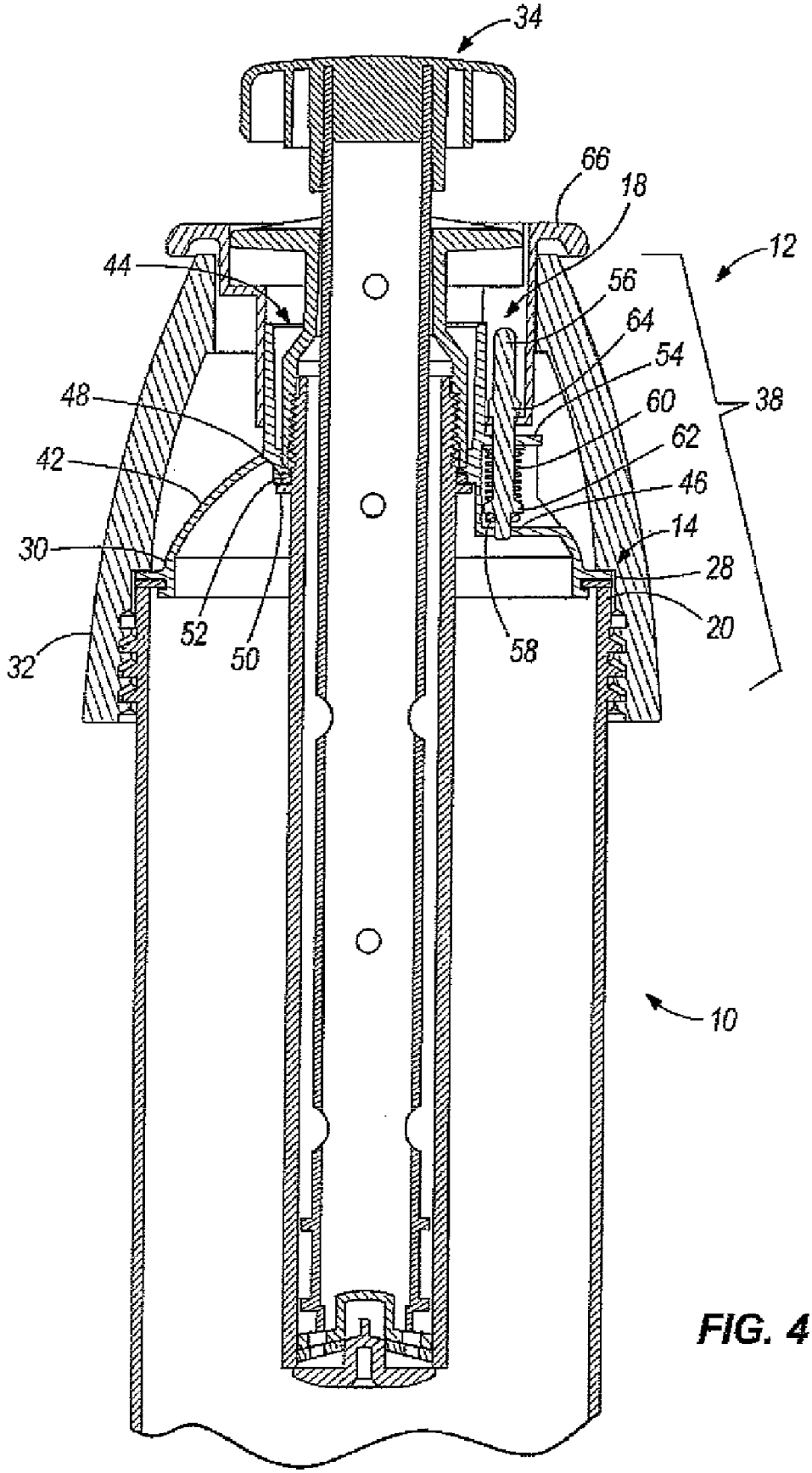

FIG. 4 is a cross-sectional view of the container and closure shown in FIG. 1 with a vent assembly actuated.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

FIGS. 1-4 show a variety of views of a container 10 coupled to a closure 12 embodying aspects of the invention. The closure 12 has many improvements over the prior art, specifically European Patent No. 1,180,343, which will be discussed in detail below. First, the sealing arrangement 14 between the closure 12 and the container 10 substantially eliminates the wear caused by the prior art. Further, the exterior of the closure has an enlarged grip area 16 with a tapered profiled to allow many different hand sizes to easily grasp and rotate the closure 12. Finally, the closure 12 is provided with an improved venting system 18.

Figure 2:
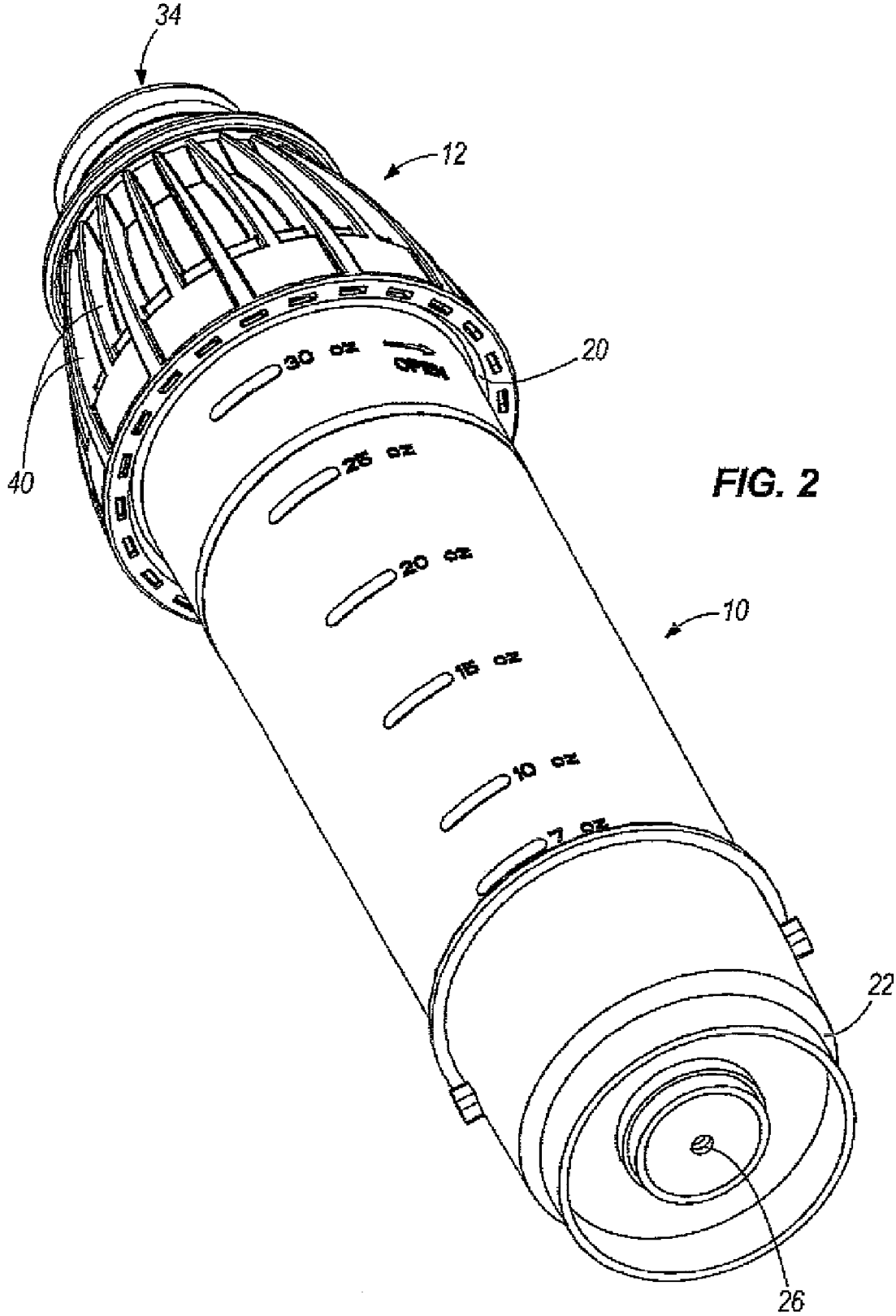
FIG. 2 is a bottom perspective view of the container and closure shown in FIG. 1.
Figure 3:
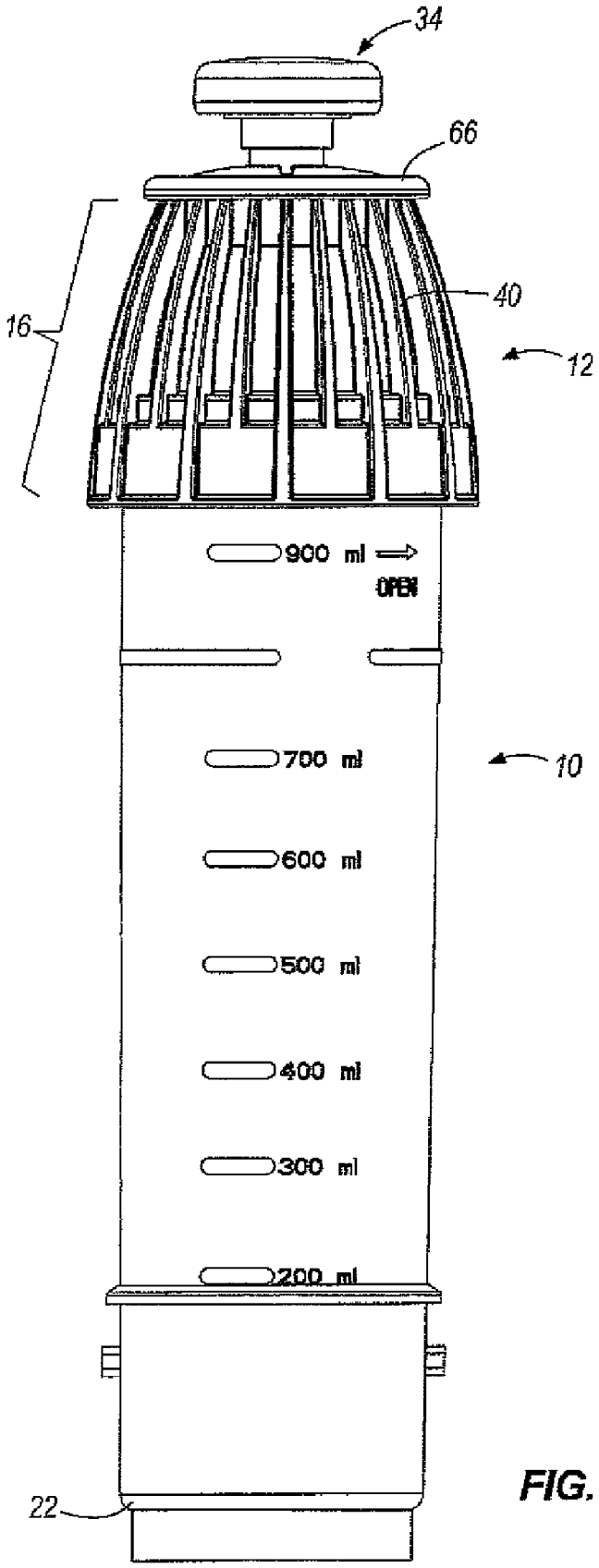

With reference to FIGS. 1-3, the container 10 and closure 12 is adapted to maintain, pressurize, and deliver a pressurized cleaning or treating solution. Specifically, the container 10 is a generally cylindrical body having a top 20 and bottom 22 (in most normal operations). The top 20 is provided with threads 24 to allow the closure 12 to engage the container 10. The bottom 22 includes a wall or surface having a having a selectively actuated valve 26 to allow a fluid stored within the container 10 to be dispensed from the container 10. Specifically, in some embodiments, a spigot will enter an opening in the bottom of the bottle 10 to actuate the valve 26, which may include a spring actuated ball bearing.

As best shown in FIG. 4, the closure includes a seal 28, a cap member 30, a threaded cap retainer or overcap 32, a pump assembly 34, and a vent assembly 18. Specifically, the seal 28 is coupled to the cap member 30 and the cap member 30 is coupled to the threaded cap retainer 32 in such a manner that the cap member 30 is independently rotatable with respect to the retainer 32. In other words, the cap member 30 can remain stationary (i.e. not rotate) while the retainer 32 is threaded onto the container 10. The vent assembly 18 and the pump assembly 34 are coupled to and supported on the cap member 30.

As illustrated, the seal 28, cap member 30, and the headed cap retainer 32 operate similar to a mason jar. In other words, the seal 28 and cap member 30 can engage the container 10 in a non-rotating manner to form a sealing engagement without providing rotational wear on the seal member 28. Specifically, the seal 28, such as a flat gasket is sandwiched between the top of the container 10 and the non-rotating cap member 30 by the rotational engagement of the threaded cap retainer 32 on the threads of the container 10. Since the cap member 30 is free to rotate relative to the cap retainer 32, the seal or sealing engagement is formed by direct downward pressure (compression) on the gasket without any additional twisting moment. Not only does this protect the integrity of the seal member 28, but it also helps to reduce the torque or force need to remove the closure 12 from the container 10.

As illustrated in FIGS. 1-3, the overcap or retainer 32 has a dome-like shaped exterior 38 that has a plurality of ribs 40. The combination of this shape and the provision of the ribs 40 also allows the closure 12 to be more easily manipulated. Specifically, the ribs 40 allow for the overcap to be better grasped for rotation. Further, the domelike or convex shape of the overcap 32 also allows multiple users of varying hand size to better grasp the overcap 32. For example, a person with smaller hands will be able to better grasp the overcap 32 closer to the top of the overcap 32.

The overcap 32 is also generally hollow. In other words, as shown in the cross-sectional figures, the dome-like shape of the overcap has an aperture extending through the axis of overcap 32. As illustrated, the aperture is substantially dome shaped. The aperture in the overcap 32 allows other assemblies of the closure to be coupled to and supported by the overcap 32. In one particular example, the aperture of the overcap 32 allows the cap or lid 30 to be independently rotatable relative to the overcap 32, much like a mason jar.

As best shown in FIG. 4, the cap member or lid 30 is substantially dome shaped 42. The cap member 30 of this embodiment is coupled to the cap retainer 32 such that is cannot be easily separated from the cap retainer 32 with disassembling certain portions of the closure 12. Specifically, as shown, the cap member 30 is coupled to the vent and pump assemblies 18 and 34, and due to the engagement of these elements, the cap member 30 is not separable from the cap retainer 32 without disassembling the closure 12.

Two openings are provided in the cap or lid. One opening 44 is for the pump assembly 34 and the other opening 46 is for the vent 18. The opening 44 for the pump assembly 34 is substantially axially located or in other words, it is positioned near the center of the lid 30. The opening 46 for the vent 18 is located radially relative the opening for the pump assembly 18.

As illustrated, the cap or lid 30 is also provided with structures for receiving and coupling to the pump assembly 34 and the vent assembly 18. For example, a rib or flange 48 is provided adjacent the opening 44 for the pump assembly 34 to allow two pieces of the pump assembly 34 (i.e., cylinder and cylinder retainer/piston guide) to be threaded together on either side of the rib or flange 48 to couple the pump assembly 34 to the cap 30. Specifically, as shown the cylinder of the pump assembly is also provided with a rib 50 to trap a seal member 52, such as an o-ring, between the flange of the cylinder and the flange of the cap. The cylinder retainer/piston guide is threadedly engaged with this flanged member to pull this member into a sealing engagement with the cap. Specifically, the cylinder has a threaded portion that extends through the aperture for engagement with a threaded portion of the piston guide. As the two pieces are threaded together, the end of the piston guide engages the flange of the cap and draws the flange of the cylinder into a position that seals the opening with the seal member.

As mentioned above, the cap 30 also has a member 54 used to support and engage the vent assembly 18. As illustrated, a surface having an aperture is positioned above the opening of the cap for the vent The aperture supports a valve stem 56 in a sliding manner, such that the valve stem 56 can slide in the axial direction of the closure 12 to selectively place a portion of the valve stem 12 in a blocking arrangement with respect the vent opening 46 in the cap 30. A seal 58 can be positioned on the valve stem 56 adjacent a flanged portion 62 to place a seal around the opening in the cap when the stem is engaged in the opening of the cap 30. A spring or other bias member 60 can be positioned between the supporting surface of the cap and the flanged member of the stem to force the stem into engagement with the opening.

The stem 56 is also provided with a second flange member 64 on the opposite side of the cap support surface. This flanged member 64 allows an actuator 66 engageable from the exterior of the overcap 32 to actuate the vent 18. As illustrated, the actuator 66 has a ring-like configuration. The member having the actuator 66 has a surface positioned with the aperture of the overcap that has an aperture which is aligned with the aperture in the support surface of the cap. Further, is aperture also supports the stem in a sliding arrangement. As best shown in FIG. 4, actuation of the ring 66 in the axial direction causes the support to engage the flanged member 64 of the stem 56 and pull the stem 56 in the axial direction, which disengages the stem seal 58 adjacent the opening 46 in the cap 30.

As illustrated, this ring 66 has a flange-like configuration that extends in the radial direction passed the end of the overcap 32. This not only provides a convenient grasping location for venting purposes, but also provides a retaining function for the cap 30 relative to the overcap 32. Specifically, the connection between the vent assembly 18 and the cap member 30 allows the zing to retain the cap in engagement with the overcap 32. In other words, unlike a mason jar configuration, wherein the cap is easily separated from the overcap, the cap of this embodiment cannot be removed from the closure via the enlarged opening in the threaded area due to this engagement.

In operation, the container 10 is filled with a liquid, such as a floor cleaning solution and the closure 12 is applied to the container to seal the container 10 for pressurization via the pump assembly 34. The closure 12 is placed in threaded engagement with the container 10 and the over cap 32 is rotated to place the cap 30 and sealing member 28 in sealing engagement with the top of the container 10. As the overcap or cap retainer 32 is threaded onto the container 10, the cap 30 generally will not rotate with respect to the overcap 32. Specifically, once the overcap 32 is threaded far enough onto the container 10, the sealing member 28 and cap member 30 will begin to engage the top of the container 10. Once the sealing member 28 and cap member 30 begin to engage the top of the container 10, the cap member 30 and seal member 28 will remain stationary relative to the overcap 32 and the top of the container 10, even as the overcap 32 is continued to be rotated. During the continued rotation of the overcap 32, the lid 30 is forced by the overcap 30 toward the top of the container 10 to sandwich or compress the sealing member 28 between the cap 30 and the top of the container 10 without rotating the seal 28 relative to the top of the container 10.

Once the container 10 is sealed, rotation of the overcap 32 relative to the container 10 will stop and the container 10 can be pressurized via the pump assembly 34. A handle on the piston of the pump can be grasped and actuated axially in a reciprocal motion relative to the closure to force air into the container via an opening (one-way valve) in the cylinder.

Once the container 10 is pressurized, the liquid can be selectively dispensed under pressure from the bottom of the container via the valve 26 in the container. In one particular use, the container can be coupled to a mop for dispensing onto a floor.

Whether or not the container 10 is empty, the pressure within the container can be relieved via the vent assembly 18. The vent 18 can be actuated automatically, such as ashen the pressure within the container is too great, or the vent can be actuated manually. To actuate the vent manually, one would grasp the ring 66 and pull the Ting manually as shown in FIG. 4. TAs pulls the valve stem 56 in the axial direction, which removes the flanged member's compression on the seal 58 adjacent the opening 46 in the cap 30.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, many inventive features have been described herein. In some embodiments, multiple inventive features have been described in combination. However, it is not necessary to use all inventive features within a single embodiment. Specifically, the embodiment illustrated in FIGS. 1-4 describes a novel sealing arrangement for a dispensable, pressurized container and a closure having many novel features, such as a new venting assembly, a tapered exterior surface, an interior dome configuration, etc. As shown in the claims below, many of these features are considered to be independently patentable. Additionally, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A dispensing assembly adapted to dispense a dispensable fluid under pressure, the dispensing assembly comprising:

a container having a first opening adapted to received dispensable fluid in to the container and a second opening adapted to selectively dispense the dispensable fluid from the container;

a closure receivable on the first opening of the container via a threaded connection and adapted to selectively form a fluid tight seal, the closure comprising:

a seal adapted to engage and selectively seal an interface between the first opening of the container and the closure;

a cap coupled to the seal; and a retainer coupled to the cap and selectively engageable with the first opening of the container via a threaded connection, the retainer adapted to couple the cap and seal to the first opening of the container, wherein the cap and seal are independently rotatable with respect to the retainer during compression of the seal between the cap and the first opening of the closure by the retainer.

2. The dispensing assembly of claim 1, wherein the seal and the cap engage the container in a non-rotating manner during compression of the seat against the container via rotation of the retainer.

3. The dispensing assembly of claim 1, further comprising a pump assembly coupled to the closure.

4. The dispensing assembly of claim 3, wherein the pump assembly is coupled to and supported on the cap.

5. The dispensing assembly of claim 1, further comprising a vent assembly coupled to the closure.

6. The dispensing assembly of claim 5, wherein the vent assembly is coupled to and supported on the cap.

7. The dispensing assembly of claim 5, wherein the vent assembly couples the cap to the retainer.

8. The dispensing assembly of claim 1, wherein the second opening of the container includes a valve to control the dispense of dispensable fluid from the container.

9. The dispensing assembly of claim 1, wherein the cap has a dome-like configuration.

10. A closure for a pressurized dispensing assembly, wherein the dispensing assembly includes a container having a first opening adapted to received dispensable fluid in to the container and a second opening adapted to selectively dispense the dispensable fluid from the container under pressure, the closure receivable on the first opening of the container via a threaded connection and adapted to selectively form a fluid tight seal, the closure comprising:

a seal adapted to engage and selectively seal an interface between the first opening of the container and the closure;

a cap coupled to the seal; and a retainer coupled to the cap and selectively engageable with the first opening of the container via a threaded connection, the retainer adapted to couple the cap and seal to the first opening of the container, wherein the cap and seal are independently rotatable with respect to the retainer during compression of the seal between the cap and the first opening of the closure by the retainer.

11. The closure of claim 10, wherein the seal and the cap engage the container in a non-rotating manner during compression of the seal against the container via rotation of the retainer.

12. The closure of claim 10, further comprising a pump assembly coupled to the closure.

13. The closure of claim 12, wherein the pump assembly is coupled to and supported on the cap.

14. The closure of claim 10, further comprising a vent assembly coupled to the closure.

15. The closure of claim 14, wherein the vent assembly is coupled to and supported on the cap.

16. The closure of claim 14, wherein the vent assembly couples the cap to the retainer.

17. A closure for a dispensable container wherein the configuration of the closure allows the closure to be grasped and treaded onto a container by users with a variety of hand sizes, the closure comprising:

a body having a top, a bottom, and a surface extending from the top to the bottom around a substantially circular perimeter, the body also having an internal recess adapted to couple the closure to and close the container, the top having a first substantially circular diameter, the bottom having a second substantially circular diameter, where the second substantially circular diameter is greater than the first substantially circular diameter; and a plurality of ribs extending along the surface of the body, the ribs extending between the bottom and the top, wherein the circumference extending around the body and the ribs increases from the top of the body to the bottom of the body.

18. The closure of claim 17, wherein the ribs are substantially parallel to each other.

19. The closure of claim 17, wherein the diameter of the body tapers substantially continuously from the bottom to the top.

20. The closure of claim 17, wherein the closure includes a means for pressurizing the container.

21. The closure of claim 20, wherein the means for pressurizing is a manual pump coupled to the closure.

22. A closure for a pressurized dispensing assembly, wherein the dispensing assembly includes a container having a first opening adapted to received dispensable fluid in to the container and a second opening adapted to selectively dispense the dispensable fluid from the container under pressure, the closure receivable on the first opening of the container via a threaded connection and adapted to selectively form a fluid tight seal, the closure comprising:

a body having an internal area adapted to couple the closure to and close the container, wherein the recess has a dome-like recess in communication with the internal volume of the container and extending away from the container.

23. The closure of claim 22, wherein the internal area comprises:

an internally threaded surface; and a circumferential shoulder adjacent the internally threaded surface and configured to rest adjacent a surface of the container, wherein the dome-like recess is coupled to the circumferential shoulder.

24. A closure having a vent assembly, the closure comprising:

a cap adapted to rest over the opening a container, the cap having an aperture adapted to selective vent gases from a container coupled to the cap; and a retainer coupled to the cap and adapted to secure the cap to the container via a threaded connection, the retainer is configured to substantially house and enclose the cap from an external environment when the closure is coupled to a container;

a valve stem positioned within the aperture and selectively movable within the aperture to block and unblock the aperture, the valve stem being housed and enclosed with the retainer;

a member coupled to the cap and positioned to support and guide the valve stem, wherein the member is housed and enclosed within the retainer; and an actuator coupled to the valve stem and out of the retainer, the actuator having a flanged surface engagable with the retainer and at least partially coupling the cap to the retainer while allowing the cap to rotate independent of the retainer.

25. The closure of claim 24, wherein the actuator has a ring like configuration.

26. The closure of claim 25, wherein a pump assembly is coupled to the closure and is positioned within the actuator ring.

* * * * *

UNITED STATES PATENT AND TRADEMARK OFFICE

CERTIFICATE OF CORRECTION

PATENT NO. : 8,104,647 B2
APPLICATION NO. : 12/306192
DATED : January 31, 2012
INVENTOR(S) : Andrew M. Bober et al.

It is certified that error appears in the above-identified patent and that said Letters Patent is hereby corrected as shown below:

Col. 6, line 1, Claim 2:

change “seal” to --seat--

Signed and Sealed this
Eleventh Day of September, 2012

David J. Kappos

David J. Kappos
*Director of the United States Patent and Trademark Office*